US011564458B1

(12) United States Patent
Pelletier

(10) Patent No.: US 11,564,458 B1
(45) Date of Patent: Jan. 31, 2023

(54) LOCKING BUCKLE ASSEMBLY

(71) Applicant: James Steven Keith Pelletier, Northampton, MA (US)

(72) Inventor: James Steven Keith Pelletier, Northampton, MA (US)

(73) Assignee: ANGLE, Northampton, MA (US)

( * ) Notice: Subject to any disclaimer, the term of this patent is extended or adjusted under 35 U.S.C. 154(b) by 0 days.

(21) Appl. No.: 17/361,539

(22) Filed: Jun. 29, 2021

Related U.S. Application Data

(60) Provisional application No. 63/056,658, filed on Jul. 26, 2020, provisional application No. 63/056,660, filed on Jul. 26, 2020.

(51) Int. Cl.
*A44B 11/25* (2006.01)

(52) U.S. Cl.
CPC ..... *A44B 11/2584* (2013.01)

(58) Field of Classification Search
CPC ..... A44B 11/2584; A44B 11/2588; A44B 11/258; A44B 99/005; Y10T 24/1394; Y10T 24/4578; F16B 21/04; F16B 21/02
See application file for complete search history.

(56) References Cited

U.S. PATENT DOCUMENTS 2,487,895 A * 11/1949 Rounds ..... A44B 11/2588 24/611
5,604,958 A * 2/1997 Anscher ..... A45F 3/04 24/165
5,626,435 A * 5/1997 Wohlhuter ..... F16B 21/02 403/348

(Continued)

FOREIGN PATENT DOCUMENTS

CN 202738973 B1 2/2013
CN 202941512 5/2013

(Continued)

OTHER PUBLICATIONS

Craftmore, Craftmemore 2sets 1-1/8" Rectangle Turn Lock Clasp Purse Closure Twist Lock Leathercraft Accessory Purse Lock (Gunmetal), Dec. 31, 2021.

(Continued)

*Primary Examiner* — Robert Sandy
(74) *Attorney, Agent, or Firm* — Paul D. Sorkin

(57) ABSTRACT

A locking buckle assembly for coupling and decoupling a web strap includes a strap plate and a base part. The base part includes a front plate and a rear cover. A locking mechanism including a release button and a locking peg is positioned between the front plate and the rear cover. The release button and the locking peg are biased by a spring through respective openings in the front plate. A lock plate is provided on a surface of the front plate. Respective longitudinal axes of the lock plate and the front plate are angularly offset from each other. The strap plate includes an opening sized to receive the lock plate and couples to the base part when the lock plate captures the strap plate and the longitudinal axes of the strap plate and the base part are aligned. In that orientation, the locking peg couples to the strap plate and the strap plate and the base part are only decoupled by pressing of the release button in opposition to the urging of the spring.

16 Claims, 16 Drawing Sheets

(56) References Cited

U.S. PATENT DOCUMENTS

| | | | | |
|---|---|---|---|---|
| 8,870,143 | B2 * | 10/2014 | Kubin | F16M 11/041 248/222.52 |
| 10,233,630 | B1 | 3/2019 | Francies, III | |
| 2006/0207072 | A1 | 9/2006 | Chen | |
| 2012/0186709 | A1 | 7/2012 | Mulaw | |

FOREIGN PATENT DOCUMENTS

| | | | |
|---|---|---|---|
| CN | 202941512 | U | 5/2013 |
| CN | 205267197 | B1 | 6/2016 |
| CN | 210901687 | U | 7/2020 |
| CN | 112353062 | B1 | 2/2021 |
| DE | 646037 | B1 | 6/1937 |
| DE | 1904043 | B1 | 2/1970 |
| DE | 202010006542 | B1 | 10/2010 |
| DE | 202013004326 | U1 | 7/2013 |
| GB | 1246705 | B1 | 9/1971 |
| KR | 101321843 | B1 | 10/2013 |

OTHER PUBLICATIONS

Dhgate, Gold silver Metal Clasp Twist Lock Buckle for Handbag Purse Bag Lock DIY Luggage Hardware Accessories BA376, Dec. 31, 2021.

DE202010006542, Oct. 14, 2010, Mammut Sports Group AG, English Translation.

CN205267197, Jun. 1, 2016, Jin Zhongyuan, English Translation.

CN202738973, Feb. 20, 2013, Huang Wenyuan, English Translation.

CN112353062, Feb. 12, 2021, Zhejiang Weixing Industrial Development Co Ltd, English Translation.

DE1904043, Feb. 19, 1970, Reitzel, George, English Translation.

DE646037, Jun. 7, 1937, Louis Witte and Co, English Translation.

KR101321843, Oct. 23, 2013, Lee, Jong Soo, English Translation.

CN210901687, Jul. 3, 2020, Lin Xiongwei; Wen Deping, English Translation.

DE202013004326, Jul. 5, 2013, Hauser, Ursula B, English Translation.

* cited by examiner

LOCKING BUCKLE ASSEMBLY

RELATED APPLICATIONS

This application claims priority to U.S. Provisional Patent Application Ser. No. 63/056,658 filed Jul. 26, 2020, for "Locking Strap Buckle" and to U.S. Provisional Patent Application Ser. No. 63/056,660 filed Jul. 26, 2020, for "Detenting Strap Buckle."

BACKGROUND

Messenger bags, laptop bags, totes and other bag styles often have straps that allow the user to sling the bag over their shoulder or across their body to the opposite shoulder. These straps are known to include a way to make the strap shorter or longer in order to position the bag in a particular location or orientation at the user's side or against their back. In some cases, this strap includes a buckle mechanism that is separable into two components that divides the strap into two portions. The two portions can be reconnected by an engaging and locking action of the buckle mechanism. Typically, each separate strap portion has one component of the buckle mechanism at its respective free end.

These buckle mechanisms are suited for the bag-strap applications described above and can be found in other applications, such as in clothing belts, climbing and safety harnesses, seatbelts and as a closure mechanism for bag flaps and the like.

The known buckle mechanism is usually hand operated by the user, i.e., a mechanical device. When engaged or locked together, the buckle components remain engaged until the user manually intercedes with the intention of separating them. The user must press, pinch or otherwise manipulate the components of the buckle mechanism to release and disengage the buckle, separating the strap. To reconnect the strap portions, the user must align and engage the buckle again.

What is needed is a buckle mechanism that improves on those that are known.

SUMMARY

One aspect of the present disclosure is directed to a locking buckle assembly comprising: a strap plate; a base part; a locking mechanism provided in the base part; a lock plate disposed on the base part; and a strap plate opening defined in the strap plate. The locking mechanism is coupled to the strap plate and maintains the strap plate and the base part in a fixed relationship with one another when the lock plate is positioned through the strap plate opening and the strap plate and the base plate are in a first predetermined arrangement. Further, the locking mechanism is decoupled from the strap plate when the strap plate and the base plate are not in the first predetermined arrangement.

In one aspect, the strap plate has a corresponding strap plate longitudinal axis; the base part has a corresponding base part longitudinal axis, and the first predetermined arrangement comprises the strap plate longitudinal axis in alignment with the base plate longitudinal axis.

In one aspect, the lock plate has a corresponding lock plate longitudinal axis offset from the base plate longitudinal axis by a predetermined angle $\alpha$.

In one aspect, the lock plate comprises: a lock plate stem portion; and a lock plate top portion comprising overhanging portions extending beyond the lock plate stem portion. The strap plate is captured between the lock plate overhanging portions and the base part when the strap plate longitudinal axis is aligned with the base plate longitudinal axis.

In one aspect, the base part comprises: a front plate; and a rear cover and the locking mechanism is provided between the front plate and the rear cover. The locking mechanism comprises: a release button; a locking peg extending from the release button; and a spring configured to bias the release button and the locking peg into, respectively, a button opening and a peg receiving opening defined in the front plate. Further, the locking peg is coupled to the strap plate to maintain the strap plate and the base part in the fixed relationship when the strap plate longitudinal axis is aligned with the base plate longitudinal axis.

In one aspect, the strap plate further comprises: a back surface; and a locking hole, defined in the back surface, configured to receive the locking peg.

In one aspect, the strap plate further comprises: a pre-locking hole defined in the back surface of the lock plate; and a ramped surface, defined in the pre-locking hole, configured to direct the locking peg toward the locking hole as the strap plate longitudinal axis and the base plate longitudinal axis are being aligned with one another.

In one aspect of the present disclosure, a lock plate opening is provided in the lock and is configured to receive, and provide access to, the release button such that the release button can be moved in opposition to the spring in order to decouple the locking peg from the strap plate.

Another aspect of the present disclosure is directed to a locking buckle assembly comprising: a strap plate having a corresponding strap plate longitudinal axis; a base part having a corresponding base part longitudinal axis; a locking mechanism provided in the base part; a lock plate, disposed on the base part, having a corresponding lock plate longitudinal axis offset from the base plate longitudinal axis by a predetermined angle $\alpha$; and a strap plate opening defined in the strap plate. When the lock plate is positioned through the strap plate opening and the strap plate longitudinal axis is aligned with the base plate longitudinal axis, the locking mechanism maintains the strap plate and the base part in a fixed relationship with one another.

In one aspect, the lock plate comprises: a lock plate stem portion; and a lock plate top portion having overhanging portions extending beyond the lock plate stem portion, wherein the strap plate is captured between the lock plate overhanging portions and the base part when the strap plate longitudinal axis is aligned with the base plate longitudinal axis.

In one aspect, the base part comprises: a front plate; and a rear cover, wherein the locking mechanism is provided between the front plate and the rear cover. The locking mechanism comprises: a release button; a locking peg extending from the release button; and a spring configured to bias the release button and the locking peg into, respectively, a button opening and a peg receiving opening defined in the front plate. Further, the locking peg is coupled to the strap plate to maintain the strap plate and the base part in the fixed relationship when the strap plate longitudinal axis is aligned with the base plate longitudinal axis.

In one aspect, the strap plate further comprises: a back surface; and a locking hole, defined in the back surface, configured to receive the locking peg.

In one aspect, the strap plate further comprises: a pre-locking hole defined in the back surface of the lock plate; and a ramped surface, defined in the pre-locking hole, configured to direct the locking peg toward the locking hole as the strap plate longitudinal axis and the base plate longitudinal axis are being aligned with one another.

In one aspect, the locking buckle assembly further comprises: a lock plate opening, provided in the lock plate, configured to receive, and provide access to, the release button such that the release button can be moved in opposition to the spring in order to decouple the locking peg from the strap plate.

Another aspect of the present disclosure is directed to a locking buckle assembly, comprising: a base part, having a corresponding base part longitudinal axis, comprising a front plate and a rear cover; a button opening defined in the front plate; a peg receiving opening defined in the front plate; and a locking mechanism, provided in the base part between the front plate and the rear cover. The locking mechanism comprises: a release button; a locking peg extending from the release button; and a spring configured to bias the release button and the locking peg into, respectively, the button opening and the peg receiving opening. Further, a lock plate is disposed on the base part and has a corresponding lock plate longitudinal axis offset from the base plate longitudinal axis by a predetermined angle $\alpha$. The lock plate comprises a lock plate stem portion and a lock plate top portion having overhanging portions extending beyond the lock plate stem portion. A lock plate opening, provided in the lock plate, is configured to receive, and provide access to, the release button, such that the locking peg can be moved in opposition to the spring.

In one aspect, the locking buckle assembly comprises a strap plate having a corresponding strap plate longitudinal axis; and a strap plate opening defined in the strap plate, wherein, when the lock plate is positioned through the strap plate opening and the strap plate longitudinal axis is aligned with the base plate longitudinal axis, the locking peg is coupled to the strap plate to maintain the strap plate and the base part in a fixed relationship with one another.

BRIEF DESCRIPTION OF THE DRAWINGS

One or more aspects of the present disclosure are discussed below with reference to the accompanying figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous components. For purposes of clarity, however, not every component may be labeled in every drawing. The figures are provided for the purposes of illustration and explanation and are not intended to be limiting. In the Figures.

DETAILED DESCRIPTION

Figure 1:
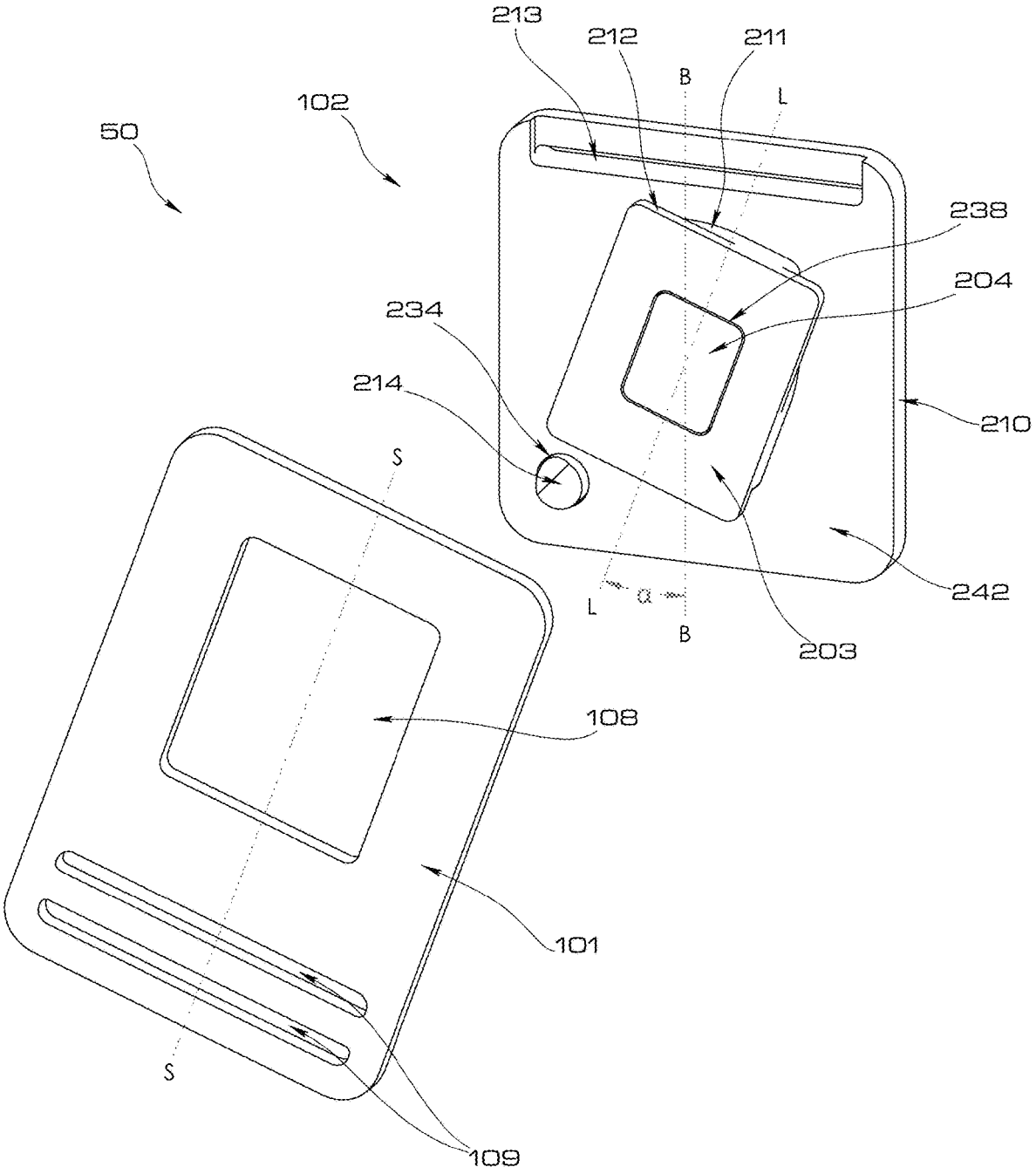
FIG. 1 is an axonometric view of a locking buckle assembly in accordance with one aspect of the present disclosure where a strap plate and a base part are in a disengaged state.

The entire contents of each of U.S. Provisional Patent Application Ser. No. 63/056,658, filed Jul. 26, 2020, for "Locking Strap Buckle" and U.S. Provisional Patent Application Ser. No. 63/056,660, filed Jul. 26, 2020, for "Detenting Strap Buckle," are hereby incorporated by reference for all purposes.

In the following detailed description, numerous specific details are set forth in order to provide a thorough understanding of the aspects and implementations of the disclosure. It will be understood by those of ordinary skill in the art that these may be practiced without some of the specific details that are set forth. In some instances, well known methods, procedures, components and structures may not have been described in detail so as not to obscure the details of the implementations of the present disclosure.

It is to be understood that the details of construction in the arrangement of the components set forth in the following description or illustrated in the drawings are not limiting. There are other ways of being practiced or carried out. Also, it is to be understood that the phraseology and terminology employed herein are for the purposes of description only and also should not be regarded as limiting.

It is appreciated that certain features, which are described in the context of separate implementations, may also be provided in combination in a single implementation. Conversely, various features, which are, for brevity, described in the context of a single implementation may also be provided separately or in any suitable sub-combination.

Figure 2:
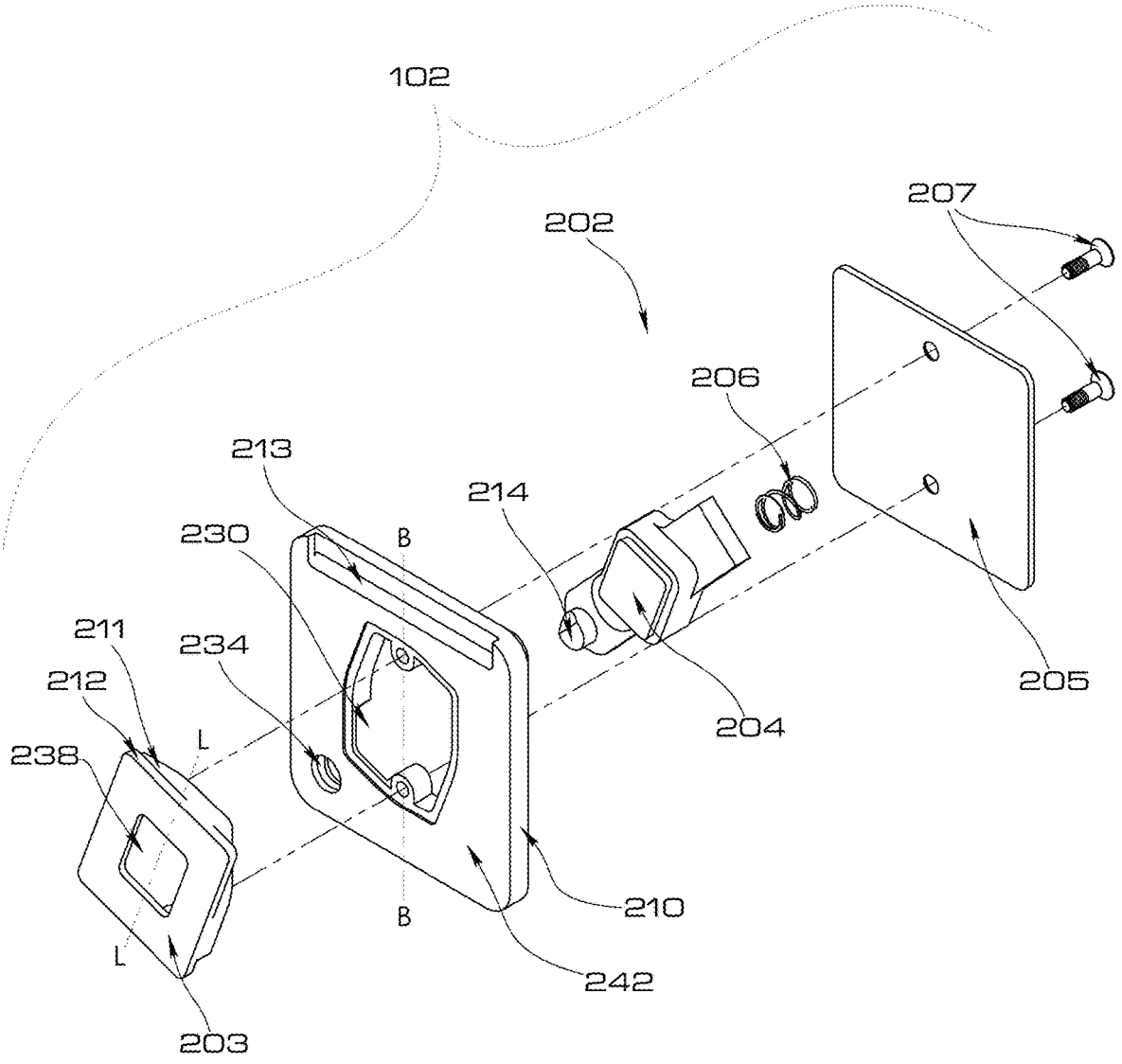
FIG. 2 is an exploded view of the base part shown in FIG. 1.

Referring generally to FIGS. 1 and 2, in accordance with one aspect of the present disclosure, a locking buckle assembly 50 includes a strap plate 101 and a base part 102. A strap plate opening 108 is defined in the strap plate 101 where, in one embodiment, the strap plate opening 108 is generally rectangular in shape. In addition, one or more strap plate web openings 109 are defined in the strap plate 101. In one embodiment, the strap plate web openings 109 are two elongated slots that are parallel to one another and which couple to a portion of web strapping. In one embodiment, the web strapping is woven through the strap plate web openings 109 to allow for adjusting the length of that web strapping portion as is understood by those of ordinary skill in the art.

As shown in FIG. 2, the base part 102 includes a lock plate 203, a release button 204, a rear cover 205 and a front plate 210. A locking mechanism 202 including a release button 204 and a spring 206 is provided between the front plate 210 and the rear cover 205. The release button 204 includes a locking peg 214 extending from the release button 204.

At least one front plate web opening 213 is defined in the front plate 210, for example, an elongated slot, to couple to another portion of web strapping. In one embodiment, the web strapping may be sewn so that the front plate 210 does not slide along the web strapping portion.

In other embodiments the strap plate web opening 109 can be a single slot and the front plate web opening 213 can comprise multiple parallel slots. The web strapping portion then can be sewn or woven through, respectively.

A button opening 230 is provided in the front plate 210 and is sized to receive the release button 204. In addition, a peg receiving opening 234 is also defined in the front plate 210 and is sized to receive the locking peg 214. The button opening 230 and the peg receiving opening 234 are oriented in the front plate 210 in order to align with the release button 204 and the locking peg 214.

The spring 206 is provided between the release button 204 and the rear cover 205. The spring 206 biases, i.e., urges, the release button 204 and, therefore, the locking peg 214, toward the front plate 210 to protrude, respectively, through the button opening 230 and the peg receiving opening 234.

The lock plate 203 includes a lock plate stem portion 211 and a lock plate top portion 212 where the lock plate top portion 212 is larger than the lock plate stem portion 211. The lock plate 203 can be a unitary construction or the lock plate stem portion 211 and the lock plate top portion 212 can be separate components that are attached to one another by any known mechanism. In addition, a lock plate opening 238 is provided in the lock plate 203 through which the release button 204 can be accessed, as will be described below in more detail.

The base part 102 is assembled by sandwiching the front plate 210, the release button 204 and the spring 206 between the lock plate 203 and the rear cover 205. In one embodiment, two screws 207 are used. As shown in FIG. 1, the release button 204 is evidenced in the lock plate opening 238 and the locking peg 214 extends through the peg receiving opening 234 by operation of the biasing spring 206.

The lock plate stem portion 211 is sized to provide that portions of the lock plate top portion 212 overhang, and are spaced a fixed distance from, a surface 242 of the front plate 210 of the base part 102.

Figure 3:
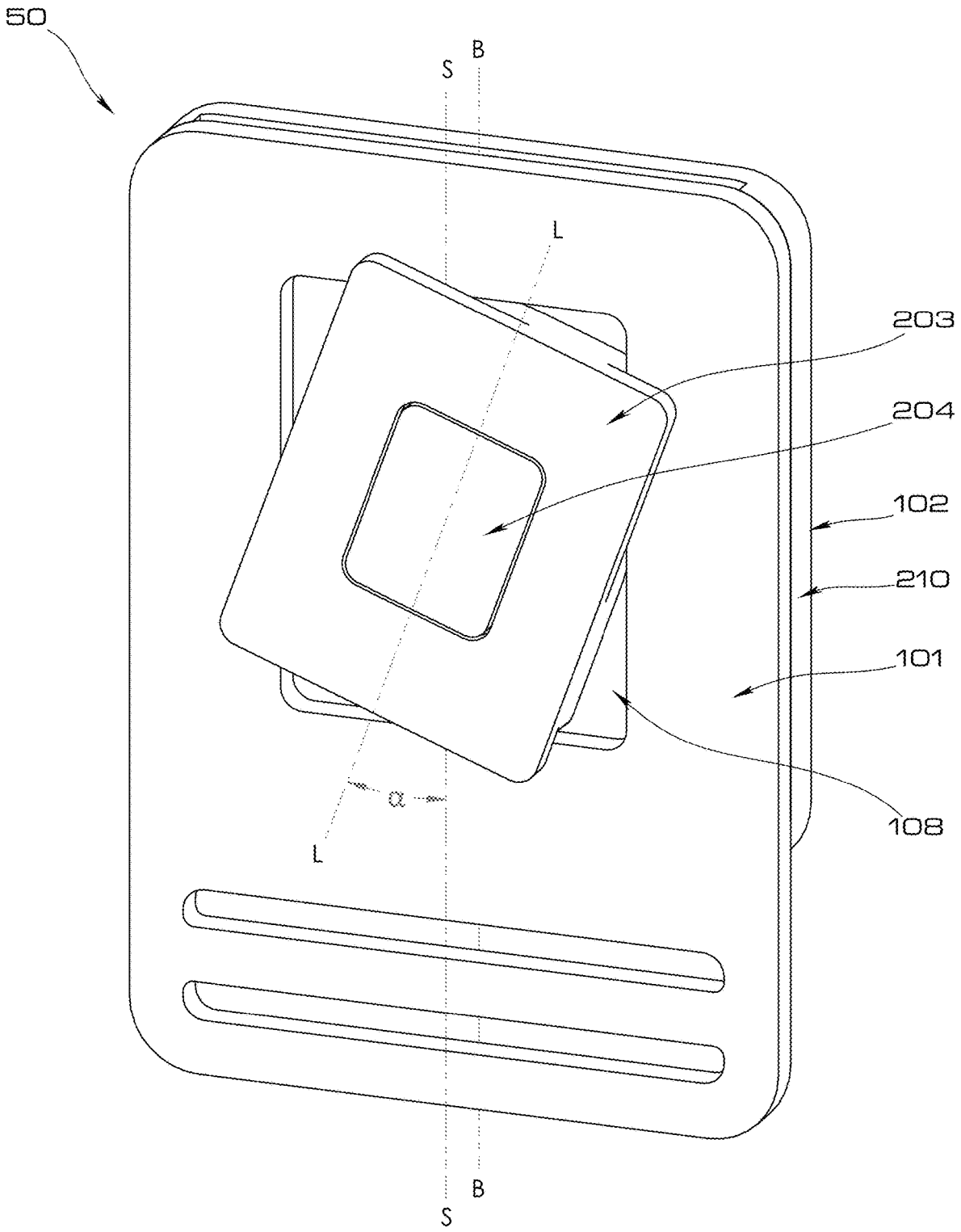
FIG. 3 is an axonometric view of the locking buckle assembly shown in FIG. 1, in an engaged, i.e., "locked" state.

For explanatory purposes herein, as shown in FIGS. 1-3 and 7, a strap plate longitudinal axis S-S is defined for the strap plate 101, a base part longitudinal axis B-B is defined for the base part 102 and a lock plate longitudinal axis L-L is defined for the lock plate 103. The base part longitudinal axis B-B and the lock plate longitudinal axis L-L, when the base part 102 is assembled, are offset from one another by an angle $\alpha$, as shown in FIGS. 1 and 3, where $20° \leq \alpha \leq 90°$.

The strap plate opening 108, in one embodiment, includes a generally rectangular perimeter that corresponds to a generally rectangular perimeter of the lock plate top portion 212.

Figure 4:
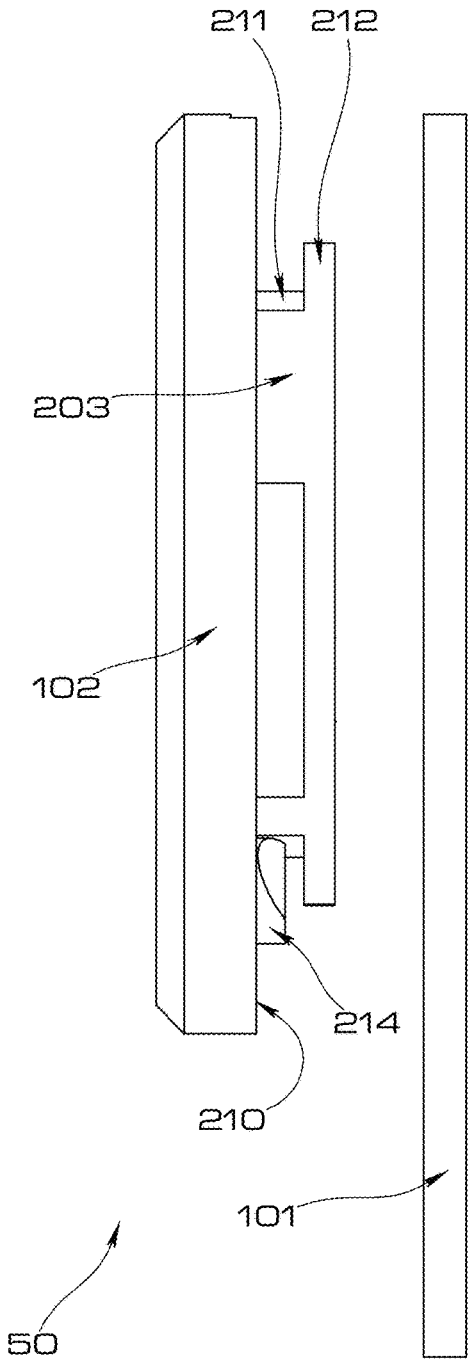
FIG. 4 is a side view of the locking buckle assembly shown in FIG. 1, in the disengaged and separated state.

The operation of coupling the strap plate 101 to the base part 102 will now be described with respect to FIGS. 1 and 3. Initially, a user aligns the strap plate longitudinal axis S-S with the lock plate longitudinal axis L-L, as shown in FIG. 1 and from a side-view in FIG. 4. The user then places the strap plate opening 108, which is slightly larger than a size of the lock plate top portion 212, over the lock plate top portion 212 such that the lock plate top portion 212 is passed through the strap plate opening 108. The size of the strap plate opening 108 is set in order to provide clearance that allows the user to align the rectangular shapes and position the strap plate 101 past the lock plate top 212.

Figure 5:
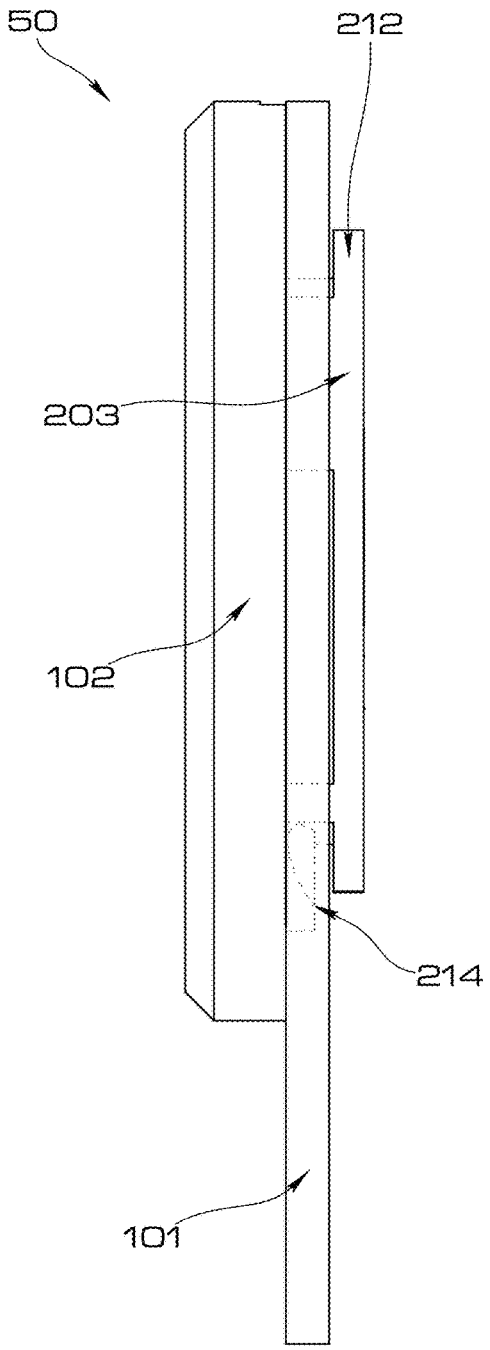
FIG. 5 is a side view of the locking buckle assembly shown in FIG. 1, in the engaged and locked state.
Figure 6:
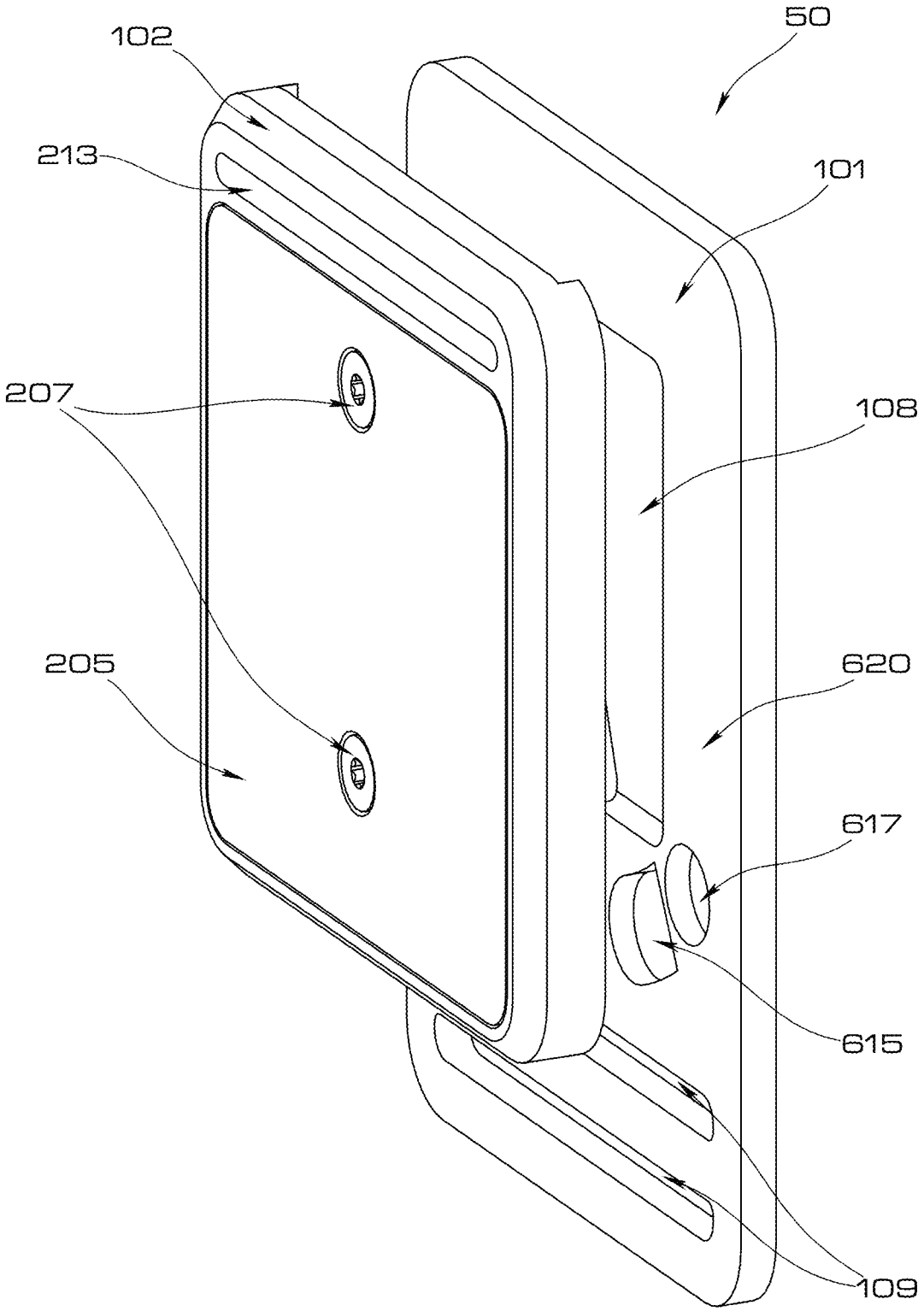
FIG. 6 is an axonometric view of the locking buckle assembly shown in FIG. 1.
Figure 7:
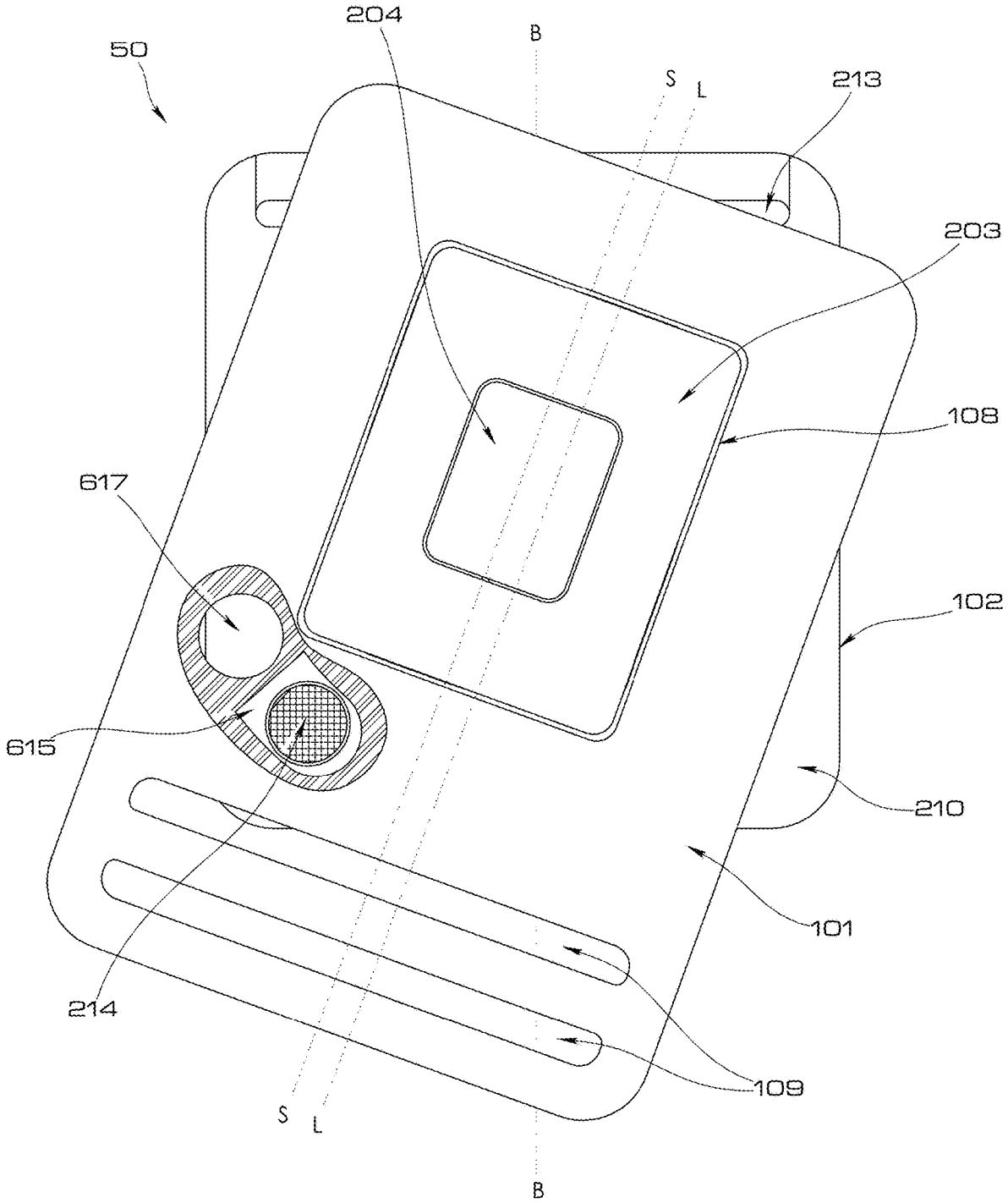
FIG. 7 is a front view, with a localized cross section detail, of the locking buckle assembly shown in FIG. 1, with its components oriented with respect to one another prior to placing the locking buckle assembly in the locked state.

The strap plate 101 is then rotated to align the strap plate longitudinal axis S-S with the base part longitudinal axis B-B, as shown in FIG. 3 and from a side-view in FIG. 5. Once against the base part front plate 210, the geometric shape of the lock plate stem portion 211 allows the strap plate 101 to be rotated in one direction by a set amount, i.e., the angle $\alpha$, so that the lock plate top portion 212 and the strap plate opening 108 are no longer aligned. Advantageously, because the strap plate 101 is now behind the overhanging features of the lock plate top portion 212, the strap plate 101 cannot be disengaged from the base part 102 without first rotating back to the position where the strap plate opening 108 is realigned with the lock plate top portion 212.

A locking mechanism is provided to prevent an inadvertent decoupling of these components. More specifically, referring to FIGS. 6-10, a pre-locking hole 615 and a locking hole 617 are defined in a back surface 620 of the strap plate 101. It should be noted that, while the pre-locking hole 615 and the locking hole 617 are shown in the Figures as a "blind hole" i.e., a "recess," either or both could be implemented as a "through-hole," i.e., an "opening" that extends through the strap plate 101.

Figure 8:
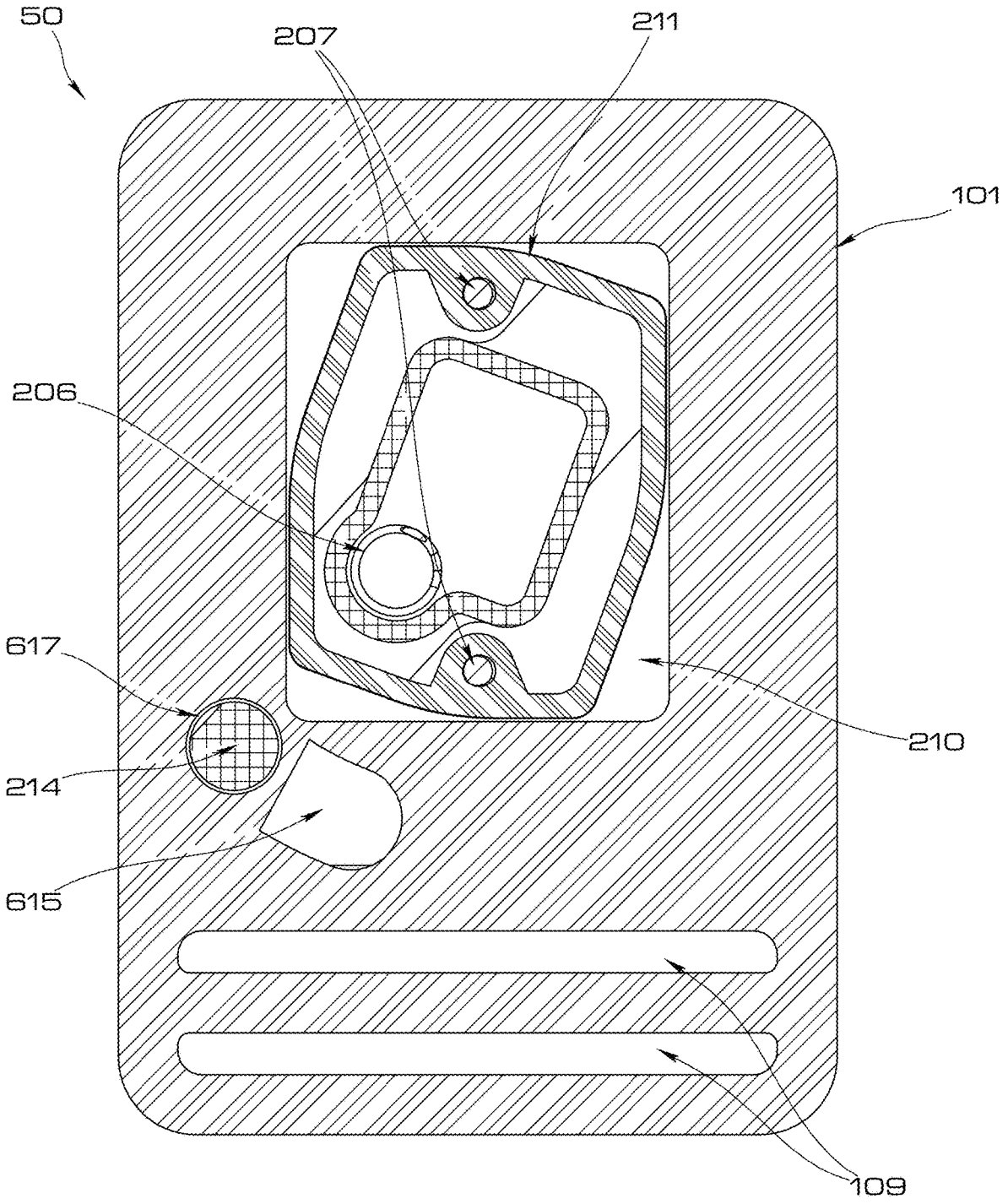
FIG. 8 is a cross section front view of the locking buckle assembly shown in FIG. 1, in the "locked" state.
Figure 9:
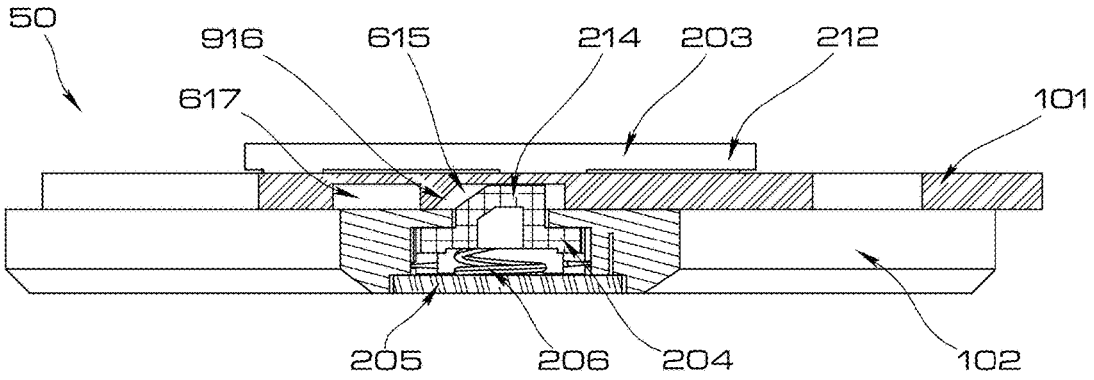
FIG. 9 is a cross section view of the locking buckle assembly shown in FIG. 1, with the strap plate angled so the strap plate opening aligns with the lock plate top.
Figure 10:
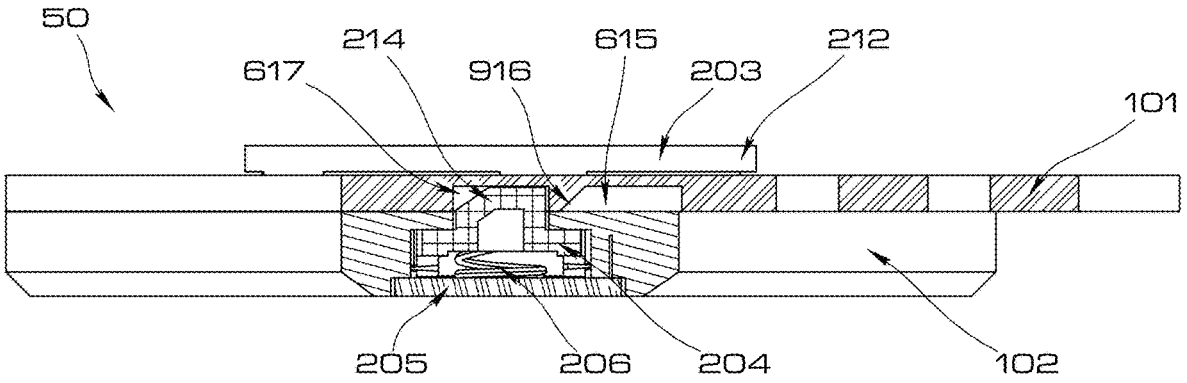
FIG. 10 is a cross section view of the locking buckle assembly shown in FIG. 1, in the "locked" state.

In FIG. 8, the cross section highlights a geometric shape of the lock plate stem portion 211 and the locking peg 214 within the locking hole 617. In FIG. 9, the cross section highlight is through the locking peg 214, showing it in the pre-locking hole 615. In FIG. 10, the cross section highlight is through the locking peg 214, showing it in the locking hole 617. The pre-locking hole 615 provides sufficient clearance around the locking peg 214 when the rectangular shapes of the strap plate opening 108 and the lock plate top portion 212 are aligned and the user positions the strap plate 101 against the front plate 210 of the base part 102.

The pre-locking hole 615 includes a ramped surface 916, shown in FIG. 9, that positions the locking peg 214 back inside the base part 102, compressing the spring 206, as the user rotates the strap plate 101 to the "locked" position. The ramped surface 916 contacts the locking peg 214 after the strap plate 101 is partly behind the overhanging features of the lock plate top 212, so that the strap plate 101 is not prevented from rotating by the sides of the lock plate top 212.

Once the strap plate 101 is rotated all the way to the "locked" position, the locking peg 214 is aligned with the locking hole 617 on the back surface 620 of the strap plate 101. The spring 206 biases the release button 204 forward, and the locking peg 214 protrudes into the locking hole 617 of the strap plate 101. The locking peg 214 now prevents the strap plate 101 from rotating, disengaging and separating.

When the user wishes to disengage the strap plate 101 from the base part 102, they press the release button 204, compressing the spring 206 and causing the locking peg 214 to recede into the base part 102, i.e., out of the locking hole 617 of the strap plate 101. This allows the user to rotate the strap plate 101 back to the position where the rectangular shape of the strap plate opening 108 aligns with the locking plate top 212. Once aligned, the user can pull the strap plate 101 away from the base part 102.

Advantageously, when the strap plate 101 and the base part 102 are engaged, i.e., in the "locked" state, an incidental pressing of the release button 204 is not sufficient to disengage and separate the strap plate 101 from the base part 102. As described above, the strap plate 101 must also be rotated until the rectangular perimeter shape of the strap plate opening 108 aligns with the lock plate top portion 212 before any separation of the components is possible. In the buckle assembly's "locked" state, the base part 102 and the strap plate 101 are generally aligned such that their respective strap plate web openings 109, 213 are parallel. Therefore, any tension in the loaded strap imparts forces that keep the base part 102 and strap plate 101 aligned in the locked condition and the user must act against that tension in order to rotate the strap plate 101 and separate the components. This further makes the buckle assembly 50 less susceptible to an accidental separation, particularly under load, because a loaded strap cannot provide the rotational forces necessary to separate the buckle assembly components described above.

Engaging and disengaging the buckle assembly 50 is intuitive to the user. An audible sound is heard as the user rotates the strap plate 101 to the "locked" position, when the locking peg 214 "pops" into the locking hole 617 of the strap plate 101. Visual feedback of the buckle's "locked" state is also provided when the strap plate web openings 109 and the base part web openings 213 are parallel to one another. This arrangement confirms that the strap plate 101 is between the front surface 242 and the lock plate top 212 and the strap tension has aligned the base part 102 and the strap plate 101.

It should be noted that a size of the buckle assembly 50 is not limited by the exemplary embodiments described herein and can be scaled up or down, as appropriate, for different strap widths, load capacity and application requirements.

In other embodiments of the buckle assembly 50 of the present disclosure, an outline shape of the strap plate opening 108 need not match the shape of the lock plate top portion 212 as long as the chosen shape can still fit around and be positioned past the lock plate top portion 212 and then rotated to the "locked" position. Accordingly, many geometric shapes with these features are possible in other embodiments, e.g., square, pentagonal, elliptical, etc.

In other embodiments of the buckle assembly 50 of the present disclosure, different amounts of angular rotation, i.e., the angle $\alpha$, or different rotation directions, i.e., clockwise vs counterclockwise, could be employed to transition from the state where the strap plate opening 108 aligns with the lock plate top portion 212 and the "locked" position.

In one embodiment of the buckle assembly 50, the base part 102 and lock plate 203 are separate components, but other embodiments might combine these two into one component. One embodiment includes a compression spring 206, but the same functionality could be accomplished by a leaf spring or a flexure in one of the components. Assembly of the embodiment of the buckle assembly 50 described herein uses the screws 207, but rivets, molded snap features, ultrasonic welding, or other assembly techniques known to those of ordinary skill in the art could also be used.

In one embodiment of the buckle assembly 50, the pre-locking hole 615, and the locking hole 617 in the strap plate 101 receive the locking peg 214, as described. In another embodiment, the pre-locking hole 615 is not provided as the strap plate 101 can function to push back against the spring 206.

In other embodiments of the buckle assembly 50, instead of a locking peg 214 protruding into a pre-locking hole 615 in the strap plate 101, a similar element could latch onto an edge or into a notch on the strap plate 101, preventing the strap plate 101 from rotating without the user manually engaging a release.

Regarding materials, all components in all embodiments of the locking buckle assembly 50 could be fabricated using a wide variety of materials, including plastics, reinforced plastics, carbon fiber, and any number of metals, depending on application requirements such as, but not limited to, load, wear resistance and cost.

Figure 11:
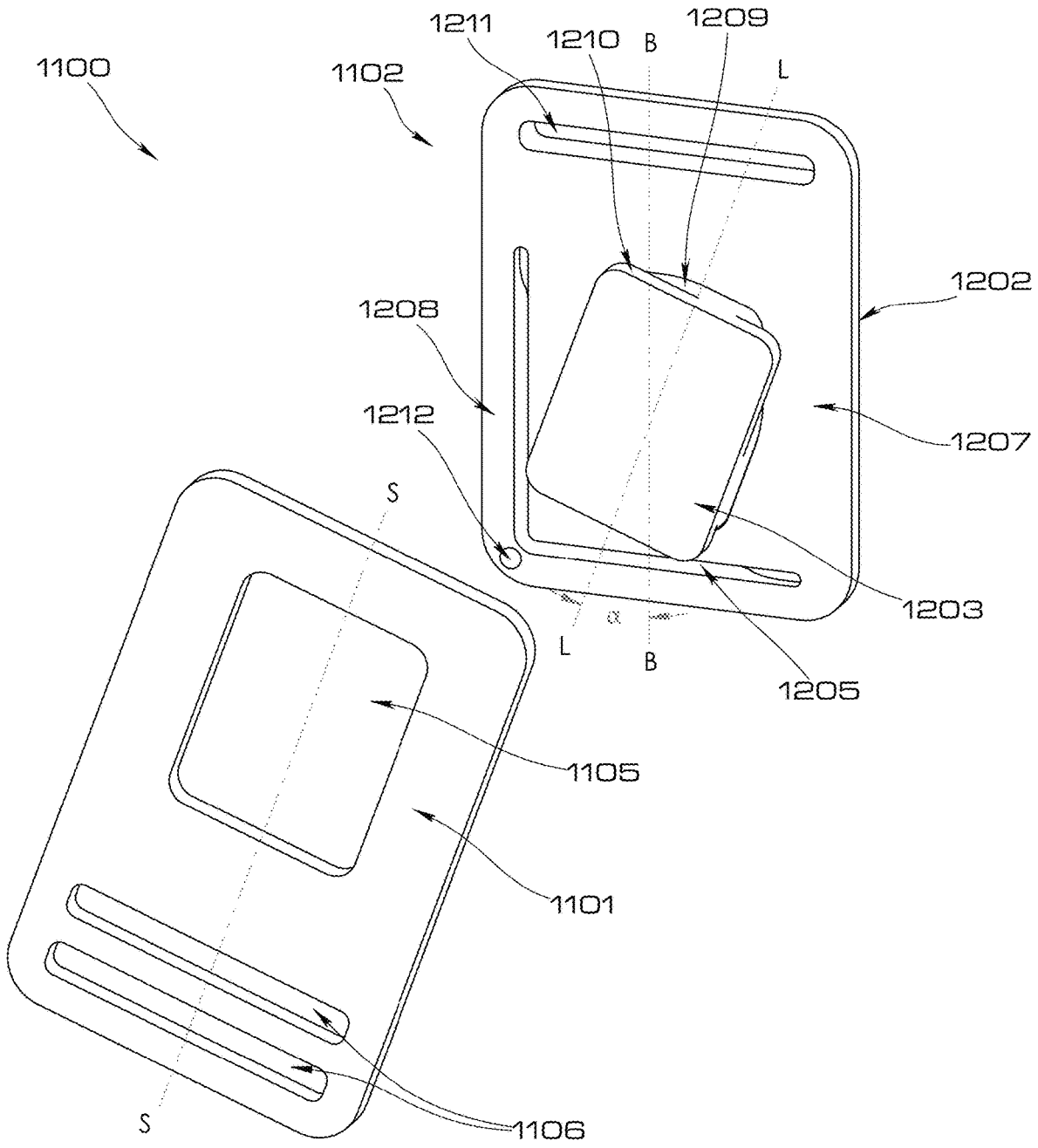
FIG. 11 is an axonometric view of a detenting buckle assembly in accordance with one aspect of the present disclosure where a strap plate and a base part portion are in a disengaged state.
Figure 12:
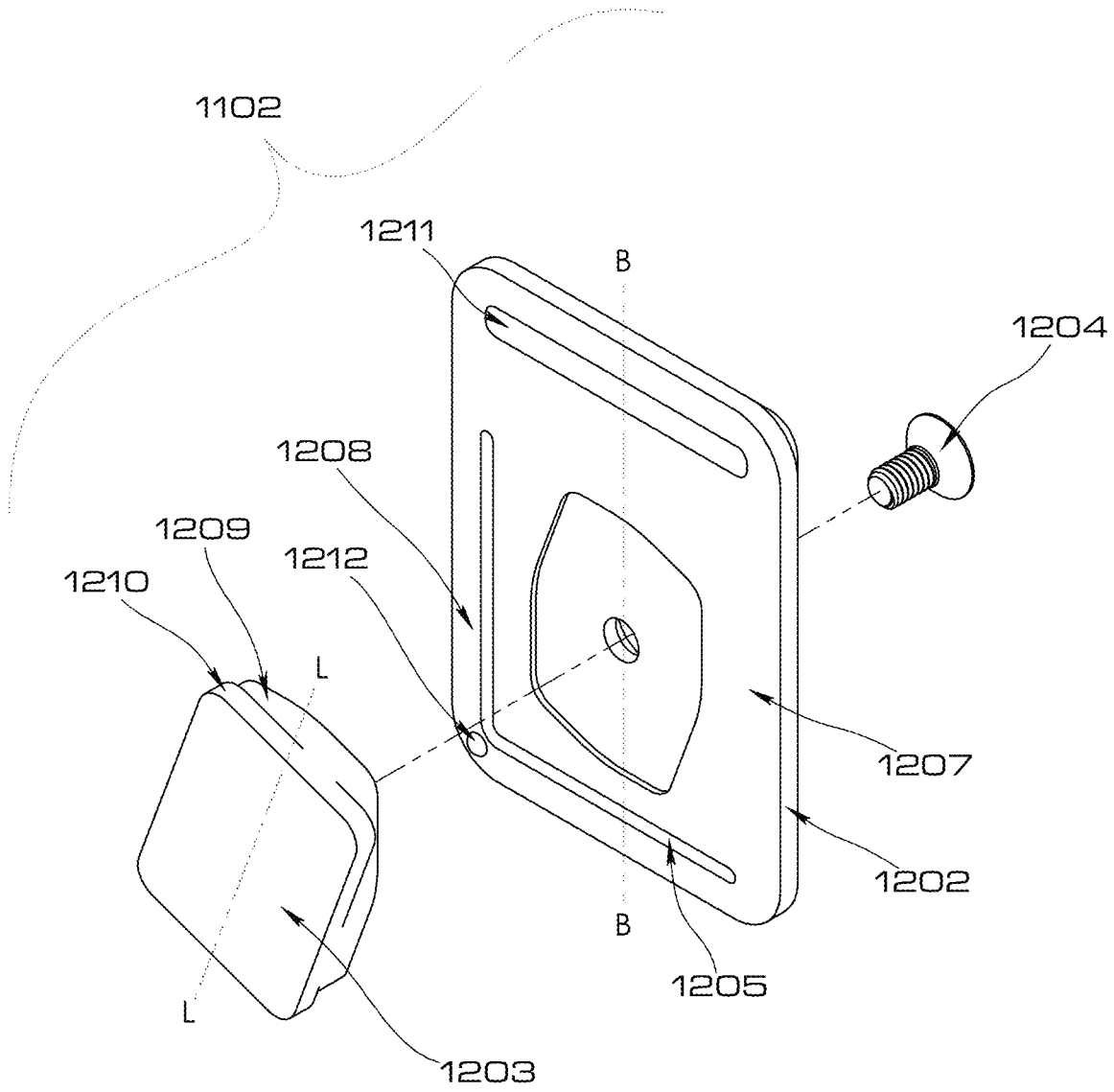
FIG. 12 is an exploded view of the detenting buckle assembly base part shown in FIG. 11.

Referring generally to FIGS. 11 and 12, in accordance with another aspect of the present disclosure, a detenting buckle assembly 1100 includes a strap plate 1101 and a base part portion 1102. A strap plate opening 1105 is defined in the strap plate 1101 where, in one embodiment, the strap plate opening 1105 is generally rectangular in shape. In addition, one or more strap plate web openings 1106 are defined in the strap plate 1101. In one embodiment, the strap plate web openings 1106 are two elongated parallel slots that couple to a portion of web strapping. In one embodiment, the web strapping is woven through the strap plate web openings 1106 to allow for adjusting the length of that web strapping portion as is understood by those of ordinary skill in the art.

As shown in FIG. 12, the base part portion 1102 includes a base plate 1202, and a lock plate 1203 that is assembled to the base part 1202 by, in one embodiment, a screw 1204. An L-shaped slot 1205 is provided in the base plate 1202 and defines an integral flexing member 1208. A detent bump 1212 is provided on the integral flexing member 1208 and stands proud of a base part front surface 1207 of the base plate 1202 when the flexing member 1208 is in its normal, relaxed position.

At least one base plate web opening 1211 is defined in the base plate 1202, for example, an elongated slot, to couple to another portion of web strapping. In one embodiment, the web strapping may be sewn so that the front plate 210 does not slide along the web strapping portion.

In other embodiments, the strap plate web openings 1106 can be a single slot and the base plate web opening 1211 can comprise multiple parallel slots. The web strapping portion then can be sewn or woven through, respectively.

The lock plate 1203 includes a lock plate stem portion 1209 and a lock plate top portion 1210 where the lock plate top portion 1210 is larger than the lock plate stem portion 1209. The lock plate stem portion 1209 is sized to provide that portions of the lock plate top portion 1210 overhang, and are spaced a fixed distance from, the base part front surface 1207. The lock plate 1203 can be a unitary construction or the lock plate stem portion 1209 and the lock plate top portion 1210 can be separate components that are attached to one another by any known mechanism.

For explanatory purposes herein, a strap plate longitudinal axis S-S is defined for the strap plate 1101, a base part longitudinal axis B-B is defined for the base part portion 1102 and a lock plate longitudinal axis L-L is defined for the lock plate 1203. The base part longitudinal axis B-B and the lock plate longitudinal axis L-L, when the base part portion 1102 is assembled, are offset from one another by an angle $\alpha$, as shown in FIGS. 11 and 13, where $20° \leq \alpha \leq 90°$.

The strap plate opening 1105, in one embodiment, includes a generally rectangular perimeter that corresponds to a generally rectangular perimeter of the lock plate top portion 1210.

The operation of coupling the strap plate 1101 to the base part portion 1102 will now be described with respect to FIGS. 11 and 13. Initially, a user aligns the strap plate longitudinal axis S-S with the lock plate longitudinal axis L-L, as shown in FIG. 11 and from a side-view in FIG. 14. The user then places the strap plate opening 1105, which is slightly larger than the lock plate top portion 1210, over the lock plate top portion 1210 such that the lock plate top portion 1210 is passed through the strap plate opening 1105. The size of the strap plate opening 1105 is set in order to provide clearance that allows the user to manually align the rectangular shapes and move the strap plate 1101 past the lock plate top portion 1210.

Figure 13:
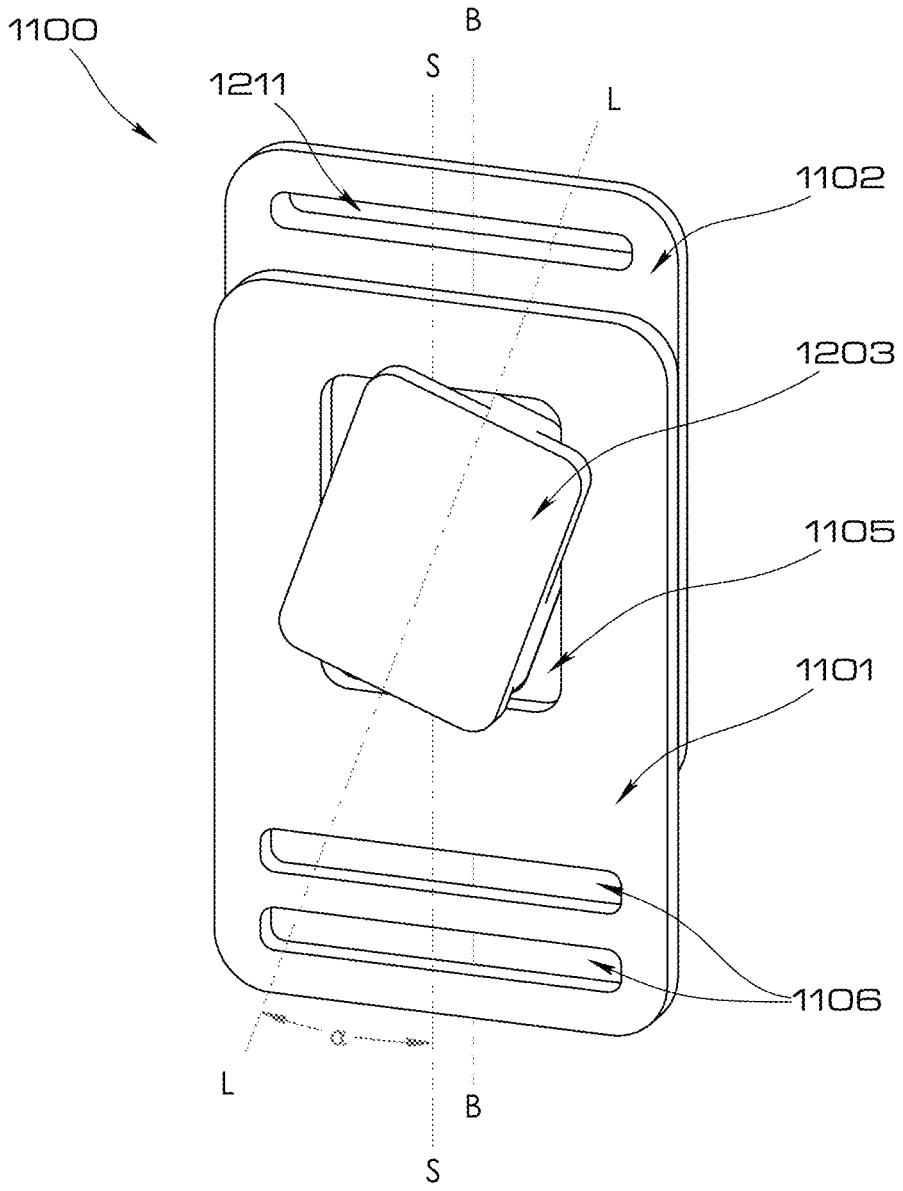
FIG. 13 is an axonometric view of the detenting buckle assembly of FIG. 11 in a detented state.
Figure 14:
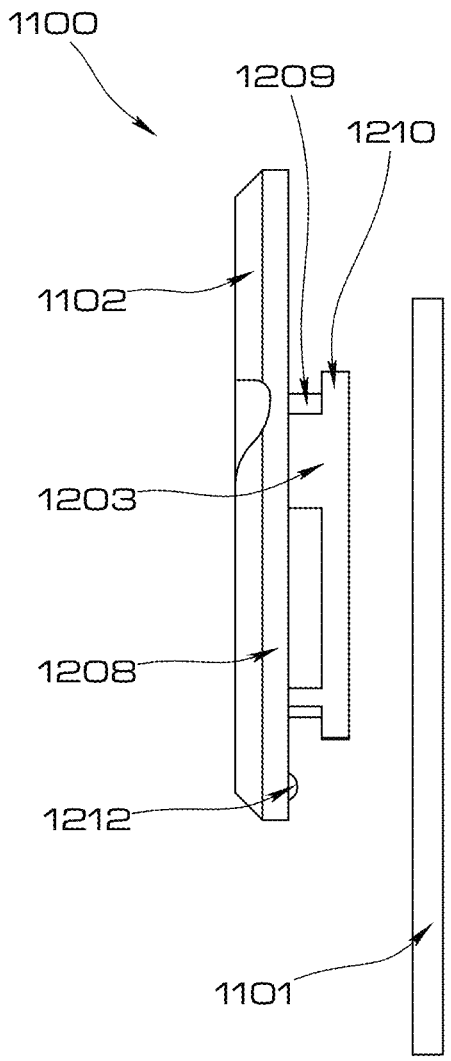
FIG. 14 is a side view of the detenting buckle assembly of FIG. 11 in the disengaged state.
Figure 15:
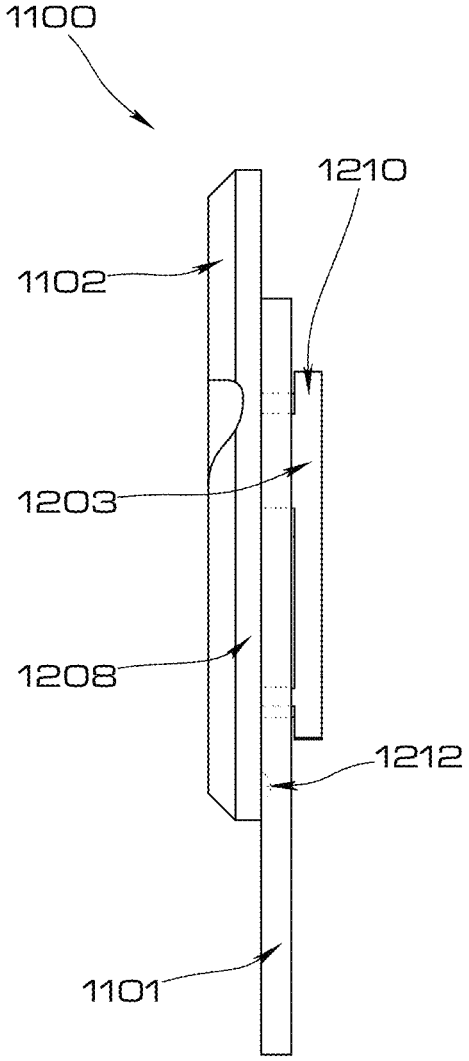
FIG. 15 is a side view of the detenting buckle assembly of FIG. 11 in the detented state.
Figure 16:
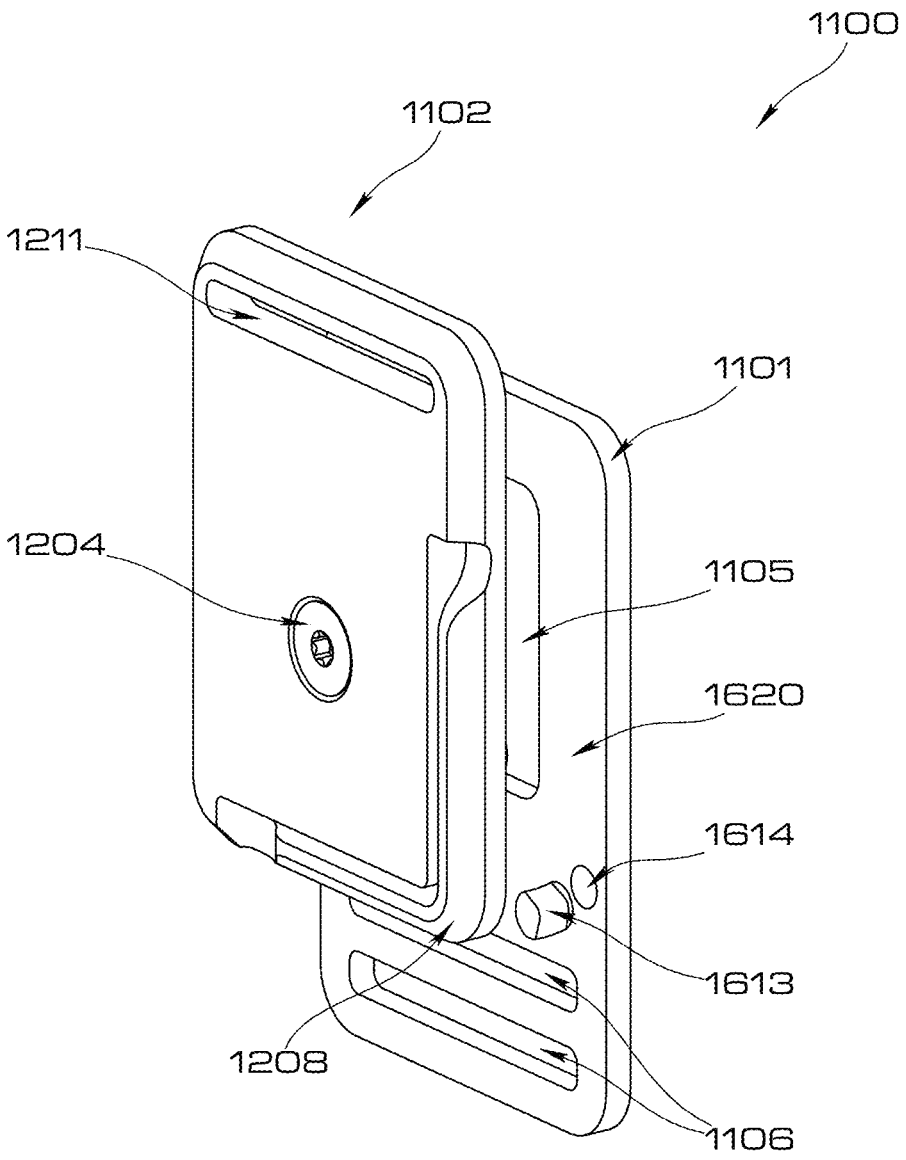
FIG. 16 is an axonometric view of the detenting buckle assembly of FIG. 11.
Figure 17:
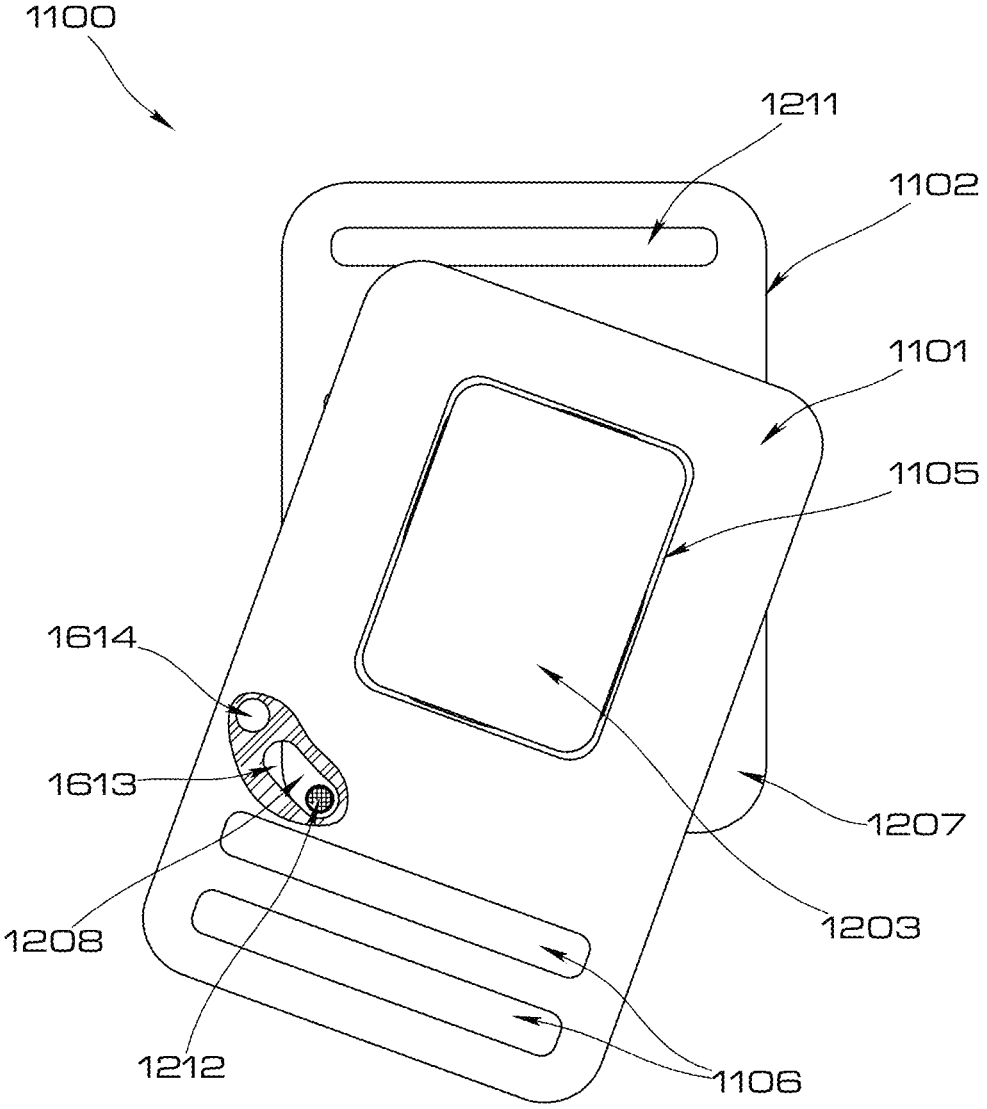
FIG. 17 is a front view, with a localized cross section detail, of the detenting buckle assembly of FIG. 11 with its components oriented with respect to one another prior to placing the detenting buckle assembly in the detented state.

The strap plate 1101 is then rotated to align the strap plate longitudinal axis S-S with the base part longitudinal axis B-B as shown in FIG. 13 and from a side-view in FIG. 15. Once against the base plate 1202, the geometric shape of the lock plate stem portion 1209 allows the strap plate 1101 to be rotated in one direction by a set amount, i.e., the angle $\alpha$, so that the lock plate top portion 1210 and the strap plate opening 1105 are no longer aligned. Advantageously, because the strap plate 1101 is now between the overhanging features of the lock plate top portion 1210 and the base plate 1202, the strap plate 1101 cannot be disengaged from the base part portion 1102 without first rotating back to the position where the strap plate opening 1105 is realigned with the lock plate top portion 1210.

A detenting mechanism is provided to prevent an inadvertent decoupling of these components. More specifically, referring to FIGS. 16-20, a pre-detent hole 1613 and a detent hole 1614 are defined on a back face 1620 of the strap plate 1101. It should be noted that, while the pre-detent hole 1613 and the detent hole 1614 are shown as a "blind hole," i.e., a "recess," either or both could be implemented as a "through-hole," i.e., an "opening" that extends through the strap plate 1101.

Figure 18:
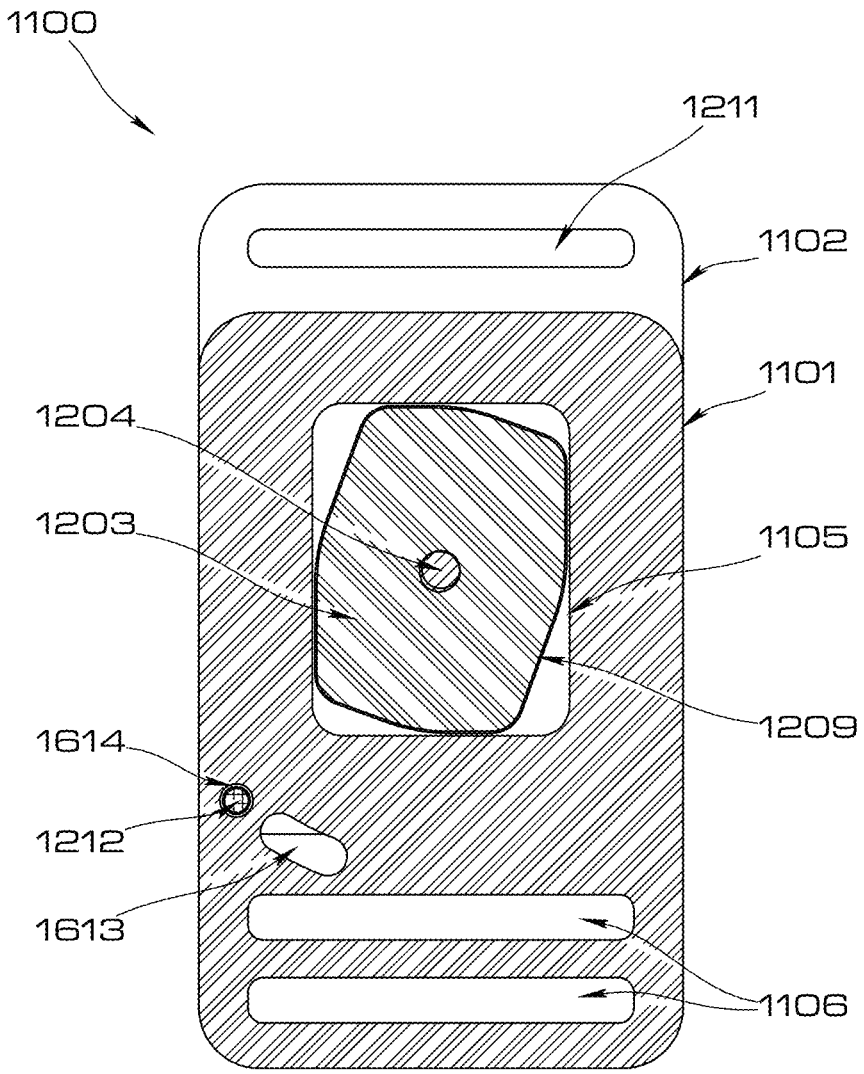
FIG. 18 is a cross section front view of the detenting buckle assembly in the detented state.
Figure 19:
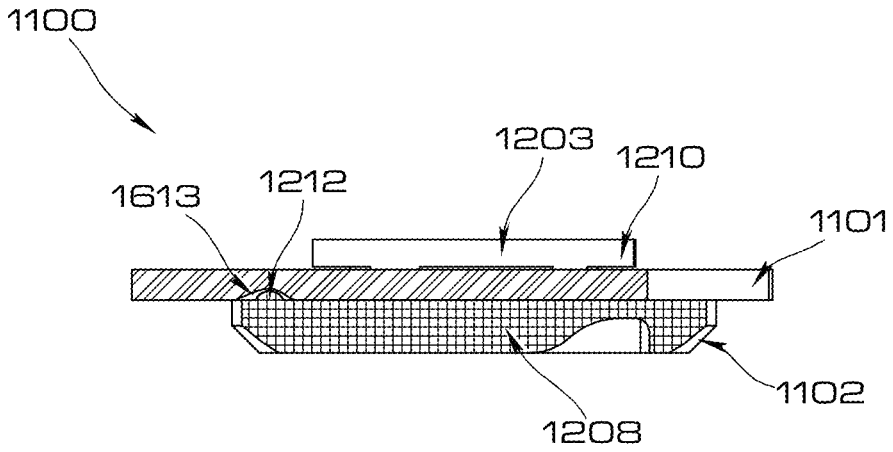
FIG. 19 is a cross section view of the detenting buckle assembly with the strap plate angled so the strap plate opening aligns with the lock plate top.
Figure 20:
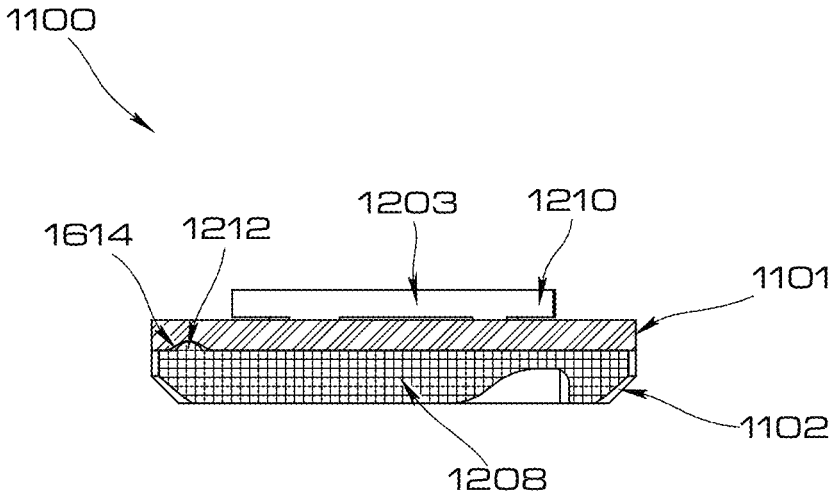
FIG. 20 is a cross section view of the detenting buckle assembly in the detented state.

In FIG. 18, the cross section highlights a geometric shape of the lock plate stem portion 1209 and the detent bump 1212 within the detent hole 1614. In FIG. 19, the cross section highlight is through the detent bump 1212 and showing in the pre-detent hole 1613. When the strap plate opening 1105 and the lock plate top portion 1210 are aligned, and the user positions the strap plate 1101 against the front surface 1207 of the base part plate 1202, the pre-detent hole 1613 surrounds and provides ample clearance about the detent bump 1212 on the flexing member 1208. As the user rotates the strap plate 1101 to a "detented" position, an angled surface of the pre-detent hole 1613 positions the detent bump 1212 into an arrangement that is sub-flush of the front surface 1207 of the base part 1202 by causing the flexing member 1208 to flex backward. Advantageously, initial contact between the angled surfaces of the pre-detent hole 1613 and the detent bump 1212 only occurs after the strap plate 1101 is already partly behind the overhanging features of the lock plate top portion 1210 so that the strap plate 1101 is not prevented from rotating by the sides of the lock plate top portion 1210.

Once the strap plate 1101 is rotated to the detented position, the detent bump 1212 is aligned with the detent hole 1614 on the back surface 1620 of the strap plate 1101. The flexing member 1208 relaxes back to its normal state, such that the detent bump 1212 is again proud of the front surface 1207 of the base part portion 1102 and is within the space afforded by the detent hole 1614. The detent bump 1212, within the detent hole 1614, prevents the strap plate 1101 from rotating, disengaging and separating.

To disengage the detent and separate the strap plate 1101 from the base part portion 1102, the user rotates the strap plate 1101 back to the position where the rectangular shapes of the strap plate opening 1105 and the lock plate top portion 1210 are aligned, i.e., where the strap plate longitudinal axis S-S and the lock plate longitudinal axis L-L are in alignment. As with the pre-detent hole 1613, the detent hole 1614 has angled surfaces that move the detent bump 1212 sub-flush of the front surface 1207 of the base part portion 1102 by causing the flexing member 1208 to flex backward, i.e., away, from the strap plate 1101. When the detent bump 1212 is again aligned with the pre-detent hole 1613, the flexing member 1208 relaxes back to its normal state. The strap plate 1101 can then rotate and disengage from the base part portion 1102.

In the detented state of the detented buckle assembly 1100, the base part portion 1102 and the strap plate 1101 are generally aligned such that the strap plate web openings 1106 and the base plate web opening 1211 are parallel. Any tension in the loaded strap, therefore, imparts forces that keep the base part portion 1102 and strap plate 1101 aligned in the detented state and the user must act against that tension in order to rotate the strap plate 1101 and separate the components of the buckle assembly 1100. This arrangement makes the buckle assembly 1100 less susceptible to an accidental separation, particularly under load, because a loaded strap cannot provide the rotational forces necessary to separate the buckle assembly components described above.

Advantageously, engaging and disengaging the buckle assembly 1100 is intuitive to the user because a tactile effect is felt as the user rotates the strap plate 1101 to and from the detented position. This tactile effect occurs when the detent bump 1212 "pops" between the pre-detent hole 1613 and the detent hole 1614 due to the action of the flexing member 1208. Visual affirmation of the buckle 1100 being in the detented state and, therefore, in a secure state, is indicated when the strap plate web openings 1106 and the base plate web opening 1211 are parallel to one another. This arrangement confirms that the strap plate 1101 is between the front surface 1207 of the base part portion 1102 and the lock plate top portion 1210 and the strap tension has aligned the base part portion 1102 and the strap plate 1101.

It should be noted that a size of the detenting buckle assembly 1100 is not limited by the exemplary embodiments described herein and can be scaled up or down, as appropriate, for different strap widths, load capacity and application requirements.

In other embodiments of the detenting buckle assembly 1100, an outline shape of the strap plate opening 1105 need not match the shape of the lock plate top portion 1210 as long as the chosen shape can still fit around and be positioned past the lock plate top portion 1210 and then rotated to the detented position. Accordingly, many geometric shapes for these features are possible in other embodiments, e.g., square, pentagonal, elliptical, etc.

In other embodiments of the detenting buckle assembly 1100, different amounts of angular rotation, i.e., the angle $\alpha$, or a different rotation direction of either clockwise or counterclockwise, could be employed to transition from the state where the strap plate opening 1105 aligns with the lock plate top portion 1210 and the detented state.

In one embodiment of the detenting buckle assembly 1100, the base part portion 1102 and lock plate 1203 are separate components, but other embodiments might combine these two into one component. One embodiment includes the flexing member 1208 integral to the base part portion 1102 but the flexing member 1208 could be a separate component assembled to the base part portion 1102 in other embodiments. Assembly of an embodiment of the detenting buckle assembly 1100 described herein is by a screw 1204, but a rivet, molded snap features, ultrasonic welding, or other assembly techniques known to those of ordinary skill in the art could also be used.

In one embodiment of the detenting buckle assembly 1100, the pre-detent hole 1613 and the detent hole 1614 in the strap plate 1101 receive the detent bump 1212, as described above. In one embodiment, the pre-detent hole 1613 is not provided.

In other embodiments of the detenting buckle assembly 1100, instead of a detent bump 1212 protruding into a detent hole 1614 in the strap plate 1101, a similar element could latch onto an edge or into a notch on the strap plate 1101, preventing the strap plate 1101 from rotating without the user manually engaging a release.

Regarding materials, excepting the components that includes the flexing member, all components in all embodiments of the detenting buckle assembly 1100 could be fabricated using a wide variety of materials, including plastics, reinforced plastics, carbon fiber, and any number of metals, depending on application requirements such as, but not limited to, load, wear resistance and cost. The component that includes the flexing member could be plastic, carbon fiber, or a spring metal, e.g., steel, beryllium copper, etc.

This disclosure is illustratively described above in reference to the disclosed implementations. Various modifications and changes may be made to the disclosed implementations by persons skilled in the art without departing from the scope of the disclosure as defined in the claims.

What is claimed is:

1. A locking buckle assembly, comprising:

a strap plate having a corresponding strap plate longitudinal axis;

a base part comprising a front plate and a rear cover and having a corresponding base part longitudinal axis;

a locking mechanism provided in the base part between the front plate and the rear cover;

a lock plate disposed on the base part; and a strap plate opening defined in the strap plate, wherein the locking mechanism is coupled to the strap plate and maintains the strap plate and the base part in a fixed relationship with one another when the lock plate is positioned through the strap plate opening and the strap plate and the base plate are in a first predetermined arrangement where the strap plate longitudinal axis is in alignment with the base plate longitudinal axis, wherein the locking mechanism is decoupled from the strap plate when the strap plate and the base plate are not in the first predetermined arrangement, wherein the locking mechanism comprises:

a release button;

a locking peg extending from the release button; and a spring configured to bias the release button and the locking peg into, respectively, a button opening and a peg receiving opening defined in the front plate, and wherein the locking peg is coupled to the strap plate to maintain the strap plate and the base part in the fixed relationship when the strap plate longitudinal axis is aligned with the base plate longitudinal axis.

2. The locking buckle assembly of claim 1, wherein:

the lock plate has a corresponding lock plate longitudinal axis offset from the base plate longitudinal axis by a predetermined angle $\alpha$.

3. The locking buckle assembly of claim 1, wherein the lock plate comprises:

a lock plate stem portion; and a lock plate top portion comprising overhanging portions extending beyond the lock plate stem portion, wherein the strap plate is captured between the lock plate overhanging portions and the base part when the strap plate longitudinal axis is aligned with the base plate longitudinal axis.

4. The locking buckle assembly of claim 1, wherein the strap plate further comprises:

a back surface; and a locking hole, defined in the back surface, configured to receive the locking peg.

5. The locking buckle assembly of claim 4, wherein the strap plate further comprises:

a pre-locking hole defined in the back surface of the strap plate; and a ramped surface, defined in the pre-locking hole, configured to direct the locking peg toward the locking hole as the strap plate longitudinal axis and the base plate longitudinal axis are being aligned with one another.

6. The locking buckle assembly of claim 1, further comprising:

a lock plate opening, provided in the lock plate, configured to receive, and provide access to, the release button such that the release button can be moved in opposition to the spring in order to decouple the locking peg from the strap plate.

7. A locking buckle assembly, comprising:

a strap plate having a corresponding strap plate longitudinal axis;

a base part comprising a front plate and a rear cover and having a corresponding base part longitudinal axis;

a locking mechanism provided in the base part between the front plate and the rear cover;

a lock plate, disposed on the base part, having a corresponding lock plate longitudinal axis offset from the base plate longitudinal axis by a predetermined angle $\alpha$; and a strap plate opening defined in the strap plate, wherein, when the lock plate is positioned through the strap plate opening and the strap plate longitudinal axis is aligned with the base plate longitudinal axis, the locking mechanism maintains the strap plate and the base part in a fixed relationship with one another, wherein the locking mechanism comprises:

a release button;

a locking peg extending from the release button; and a spring configured to bias the release button and the locking peg into, respectively, a button opening and a peg receiving opening defined in the front plate, and wherein the locking peg is coupled to the strap plate to maintain the strap plate and the base part in the fixed relationship when the strap plate longitudinal axis is aligned with the base plate longitudinal axis.

8. The locking buckle assembly of claim 7, wherein the lock plate comprises:

a lock plate stem portion; and a lock plate top portion having overhanging portions extending beyond the lock plate stem portion, wherein the strap plate is captured between the lock plate overhanging portions and the base part when the strap plate longitudinal axis is aligned with the base plate longitudinal axis.

9. The locking buckle assembly of claim 7, wherein the strap plate further comprises:

a back surface; and a locking hole, defined in the back surface, configured to receive the locking peg.

10. The locking buckle assembly of claim 9, wherein the strap plate further comprises:

a pre-locking hole defined in the back surface of the strap plate; and a ramped surface, defined in the pre-locking hole, configured to direct the locking peg toward the locking hole as the strap plate longitudinal axis and the base plate longitudinal axis are being aligned with one another.

11. The locking buckle assembly of claim 7, further comprising:

a lock plate opening, provided in the lock plate, configured to receive, and provide access to, the release button such that the release button can be moved in opposition to the spring in order to decouple the locking peg from the strap plate.

12. A locking buckle assembly, comprising:

a base part, having a corresponding base part longitudinal axis, comprising a front plate and a rear cover;

a button opening defined in the front plate;

a peg receiving opening defined in the front plate;

a locking mechanism, provided in the base part between the front plate and the rear cover, comprising:

a release button;

a locking peg extending from the release button; and a spring configured to bias the release button and the locking peg into, respectively, the button opening and the peg receiving opening;

a lock plate, disposed on the base part and having a corresponding lock plate longitudinal axis offset from the base plate longitudinal axis by a predetermined angle $\alpha$, the lock plate comprising a lock plate stem portion and a lock plate top portion having overhanging portions extending beyond the lock plate stem portion; and a lock plate opening, provided in the lock plate, configured to receive, and provide access to, the release button, such that the locking peg can be moved in opposition to the spring.

13. The locking buckle assembly of claim 12, further comprising:

a strap plate having a corresponding strap plate longitudinal axis; and a strap plate opening defined in the strap plate, wherein, when the lock plate is positioned through the strap plate opening and the strap plate longitudinal axis is aligned with the base plate longitudinal axis, the locking peg is coupled to the strap plate to maintain the strap plate and the base part in a fixed relationship with one another.

14. The locking buckle assembly of claim 13, wherein the strap plate further comprises:

a back surface; and a locking hole, defined in the back surface, configured to receive the locking peg.

15. The locking buckle assembly of claim 14, wherein the strap plate further comprises:

a pre-locking hole defined in the back surface of the strap plate; and a ramped surface, defined in the pre-locking hole, configured to direct the locking peg toward the locking hole as the strap plate longitudinal axis and the base plate longitudinal axis are being aligned with one another.

16. The locking buckle assembly of claim 13, wherein the strap plate is captured between the lock plate overhanging portions and the base part when the strap plate longitudinal axis is aligned with the base plate longitudinal axis.

* * * * *